US010161600B1

(12) United States Patent
Horovitz et al.

(10) Patent No.: US 10,161,600 B1
(45) Date of Patent: Dec. 25, 2018

(54) CIRCULAR LAMP

(71) Applicants: Michael Horovitz, Brookyln, NY (US); Reuven Natan Neta Horovitz, Spring Valley, NY (US)

(72) Inventors: Michael Horovitz, Brookyln, NY (US); Reuven Natan Neta Horovitz, Spring Valley, NY (US)

( * ) Notice: Subject to any disclaimer, the term of this patent is extended or adjusted under 35 U.S.C. 154(b) by 0 days.

(21) Appl. No.: 15/690,369

(22) Filed: Aug. 30, 2017

(51) Int. Cl.
*F21V 14/08* (2006.01)
*F21V 17/02* (2006.01)
*F21V 23/00* (2015.01)

(52) U.S. Cl.
CPC ..... *F21V 14/08* (2013.01); *F21V 17/02* (2013.01); *F21V 23/001* (2013.01)

(58) Field of Classification Search
CPC ..... F21V 14/00; F21V 14/006; F21V 14/04; F21V 14/045; F21V 14/08; F21V 14/085; F21V 17/02; F21V 23/001
See application file for complete search history.

(56) References Cited

U.S. PATENT DOCUMENTS 8,262,252 B2 * 9/2012 Bergman ..... F21V 5/007 362/232
2014/0313717 A1 * 10/2014 Miskin ..... F21V 14/06 362/236
2017/0159924 A1 * 6/2017 Khubani ..... F21V 29/503

* cited by examiner

*Primary Examiner* — Laura Gudorf
(74) *Attorney, Agent, or Firm* — Alphapatent Associates, Ltd; Daniel J. Swirsky

(57) ABSTRACT

A circular lamp, including: a plurality of light sources disposed around a circle; a round cogged rotatable cover, disposed above each of the light sources for allowing covering thereof, wherein the round rotatable cover includes at least one aperture, for allowing exposing the light source; interlacing means, for allowing rotating at least one of the round cogged rotatable covers, for circularly moving the at least one aperture thereof, thereby allowing determining the number of the plurality of light sources to be covered.

3 Claims, 6 Drawing Sheets

CIRCULAR LAMP

TECHNICAL FIELD

The invention relates to the field of lamps. More particularly, the invention relates to a circular lamp for adjusting the illumination thereof by physical means.

BACKGROUND

A structure of light sources placed one after the other in a line, allows deploying a straight screen on the number of light sources, selected to be covered, for physically tuning the light intensity, such as by deploying a rolled screen.

However, a structure of light sources placed one after the other in a circle, does not allow deploying a screen on the light sources, selected to be covered, for physically tuning the light intensity, since a circular screen cannot be rolled.

There is a long felt need to provide a circular lamp, allowing physical adjustment of intensity, and to provide a solution to the above-mentioned and other problems of the prior art.

SUMMARY

A circular lamp, including: a plurality of light sources disposed around a circle; a round cogged rotatable cover, disposed above each of the light sources; and interlacing means.

BRIEF DESCRIPTION OF THE DRAWINGS

Embodiments, features, and aspects of the invention are described herein in conjunction with the following drawings.

The drawings are not necessarily drawn to scale.

DETAILED DESCRIPTION

The invention will be understood from the following detailed description of embodiments of the invention, which are meant to be descriptive and not limiting. For the sake of brevity, some well-known features are not described in detail.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

Figure 1:
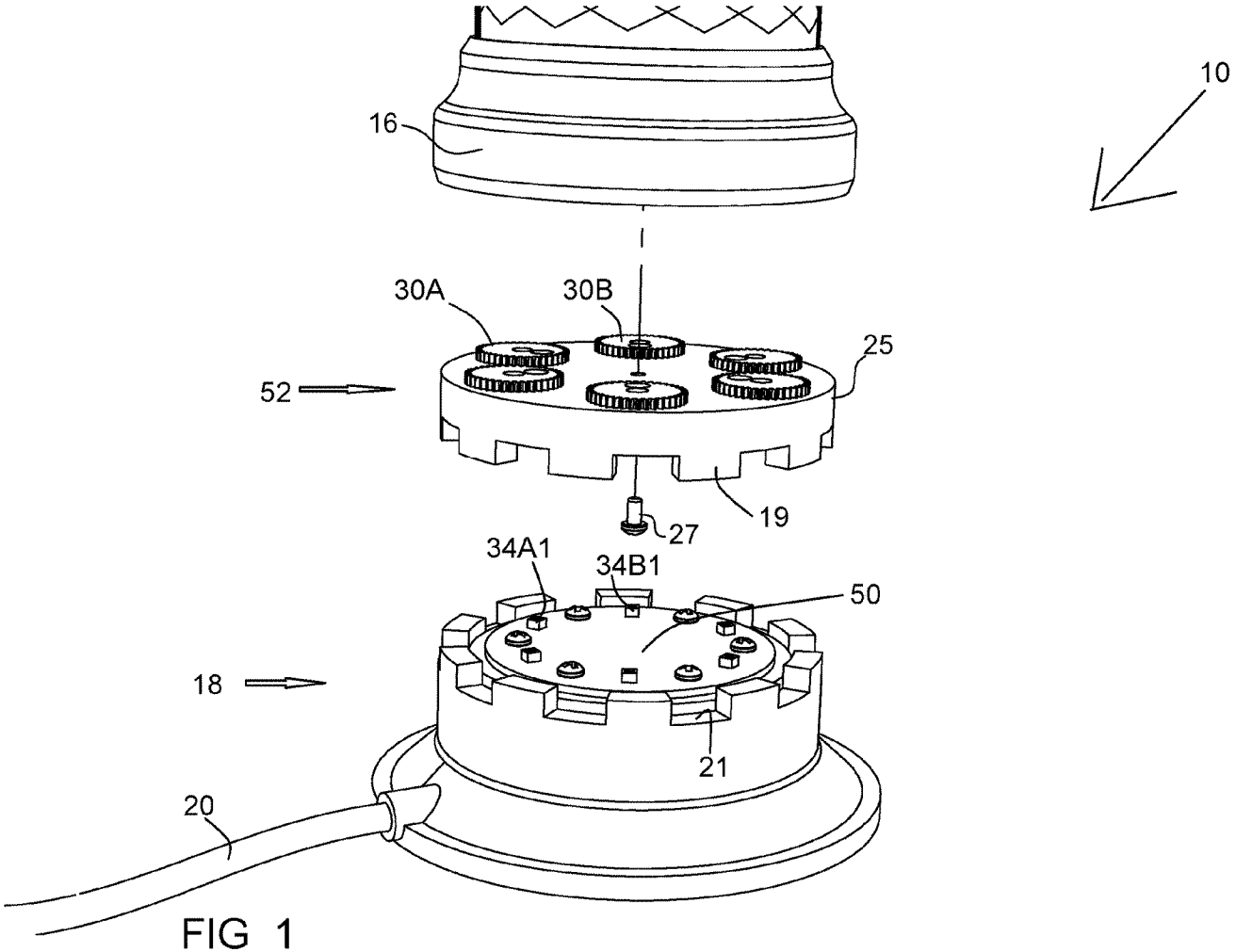
FIG. 1 is a perspective view of part of the circular lamp, being disassembled.

FIG. 1 is a perspective view of part of the circular lamp, being disassembled.

A circular lamp 10, according to one embodiment of the invention, includes an illuminating assembly 18, including a circular plate 50, including a plurality of light sources 34A1, 34B1, etc., being placed on plate 50 therearound, and being normally constantly powered (on), such as by an electric cable 20. For example, the light sources are located one after the other around as follows: 34A1, 34B1, 34C1, etc.

Circular lamp 10 further includes a covering assembly 52, including a cover for each light source, for covering the light sources or for exposing it. For example a cover 30A is disposed above light source 34A1, for covering or for exposing it; a cover 30B is disposed above light source 34B1, for covering or for exposing it; etc. Thus, the covers are located one after the other around as follows: 30A, 30B, 30C, etc.

Thus, covering assembly 52 is not rotatable in relation to plate 50.

Circular lamp 10 further includes a manually operable handle 16, being rotatable in relation to covering assembly 52, for rotating covers 30A, 30B, etc. of covering assembly 52, for determining the extent of the covering thereof.

Figure 2:
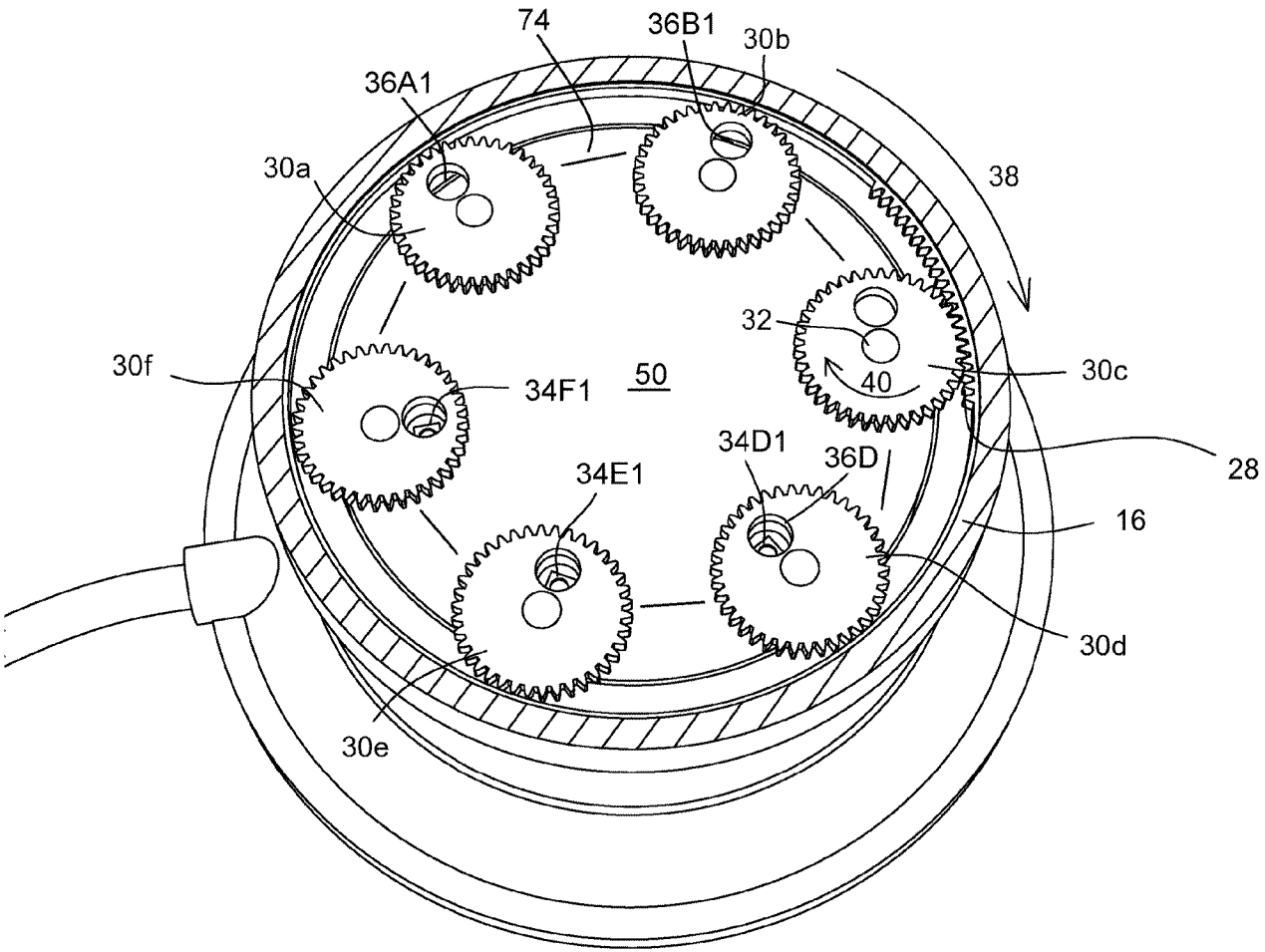
FIG. 2 is a perspective view of the assemblies of FIG. 1 assembled.

FIG. 2 is a perspective view of the assemblies of FIG. 1 assembled.

Operable handle 16 surrounds plate 50, and includes an internal circle 70 having a cogged segment 28. Each of covers 30A, 30B, etc. constitutes a round cogged plate, for being rotated, as shown by arrow 40, by cogged segment 28 of operable handle 16; and an aperture, disposed out of the center 32 of the aperture, for exposing the light source disposed below. Namely, cover 30A includes at least an aperture 36A1, cover 30B includes at least an aperture 36B1, etc.

Thus, upon rotating handle 16 to the rotational direction of arrow 38, cogged segment 28 of rotating handle 16 rotates cover 30A while not rotating cover 30D and others, then rotates cover 30B while not rotating cover 30E and others, then rotates cover 30C while not rotating cover 30F and others, as shown in FIG. 2, etc.

Figure 3:
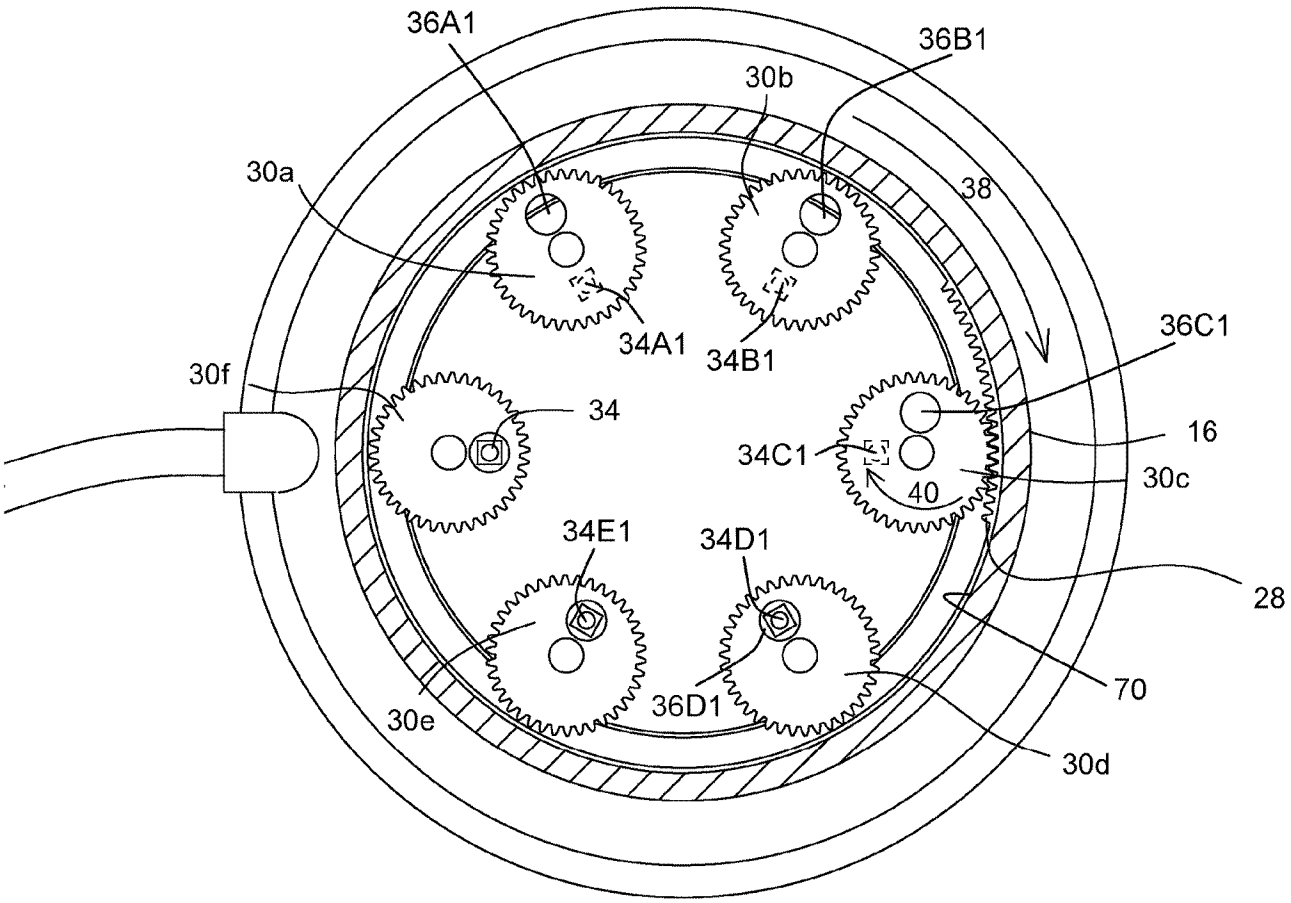
FIG. 3 is a top view of FIG. 2.

FIG. 3 is a top view of FIG. 2.

According to the example, at this current state, light sources 34D1, 34E1, and 34F1 are exposed, while covers 30A, 30B, and 30C cover light sources 34A1, 34B1, and 34C1 (shown dashed) respectively.

It may be noted that according to the embodiment of FIG. 3, the apertures of the covers which are currently not interlaced with cogged segment 28, being all apertures of FIG. 2 except for aperture 36C1 of cover 30C, are either disposed above the light source or 180 degrees therefrom. For example, aperture 36D1 is disposed above light source 34D1, whereas aperture 36A1 is disposed 180 degrees against light source 34A1.

According to the embodiment of FIG. 3, a full scan of cogged segment 28 on any of covers 30A, 30B, etc. rotates the cover along a half of the circle, i.e., by 180 degrees, and thus provides either an exposed state or a covered state to the light source. Thus, according to this embodiment, cogged segment 28 includes a half of the number of the teeth of each cover. Thus, in the example of FIG. 3, cogged segment 28 includes 20 teeth, whereas each of covers 30A, 30B, etc. includes 40 teeth.

In another words, the number of teeth, being 40 teeth, of each of round cogged rotatable covers 30A, 30B, etc., divided by the number of teeth of cogged segment 28, being 20 teeth, is 2, being an integer, thus the reciprocal of the integer 2, being a half, determines the extent of the rotation of round cogged rotatable cover 30A, meaning it rotates along a half of the circle.

Thus, the rotation along half of the circle provides that after the first scan, the aperture will be disposed accurately above the light source; after the second scan, the aperture will be disposed accurately against the light source; and after the third scan, the aperture will be disposed accurately again above the light source, without any deviation.

Thus, the reciprocal (½) of the integer 2, as determining the rotation extent, ensures that full scans of cogged segment 28 on any of round cogged rotatable covers 30A, 30B, etc. provide accurate appearances of apertures 36A1, 36B2, etc., each above the light source 34A1, 34B1, etc., thereof.

For the user, the function of the embodiment will be as follows. Assuming an initial state of all light sources being covered, upon rotating cogged segment 28 to scan cover 30A, only light source 34A1 will be exposed; then upon further rotating cogged segment 28 to scan cover 30B, light sources 34A1 and 34A2 will be exposed; then upon further rotating cogged segment 28 to scan cover 30C, 30D, 30E and 30F, light sources 34A1, 34B1, 34C1, 34D1, 34E1 and 34F1 will be exposed.

Then upon further rotating cogged segment 28 to scan cover 30A again, light source 34A1 will be covered, and thus light sources 34B1, 34C1, 34D1, 34E1 and 34F1 will be exposed; then upon further rotating cogged segment 28 to scan cover 30B again, light source 34B1 will be covered, and thus light sources 34C1, 34D1, 34E1 and 34F1 will be exposed; then upon further rotating cogged segment 28 to scan cover 30C, 30D, 30E and 30F, all of light sources 34A1, 34B1, 34C1, 34D1, 34E1 and 34F1 will be covered.

Thus, circular lamp 10 allows selecting the number of light sources to be covered, for physically tuning the light intensity, since circular lamp 10 does not deploy a single screen.

Figure 4:
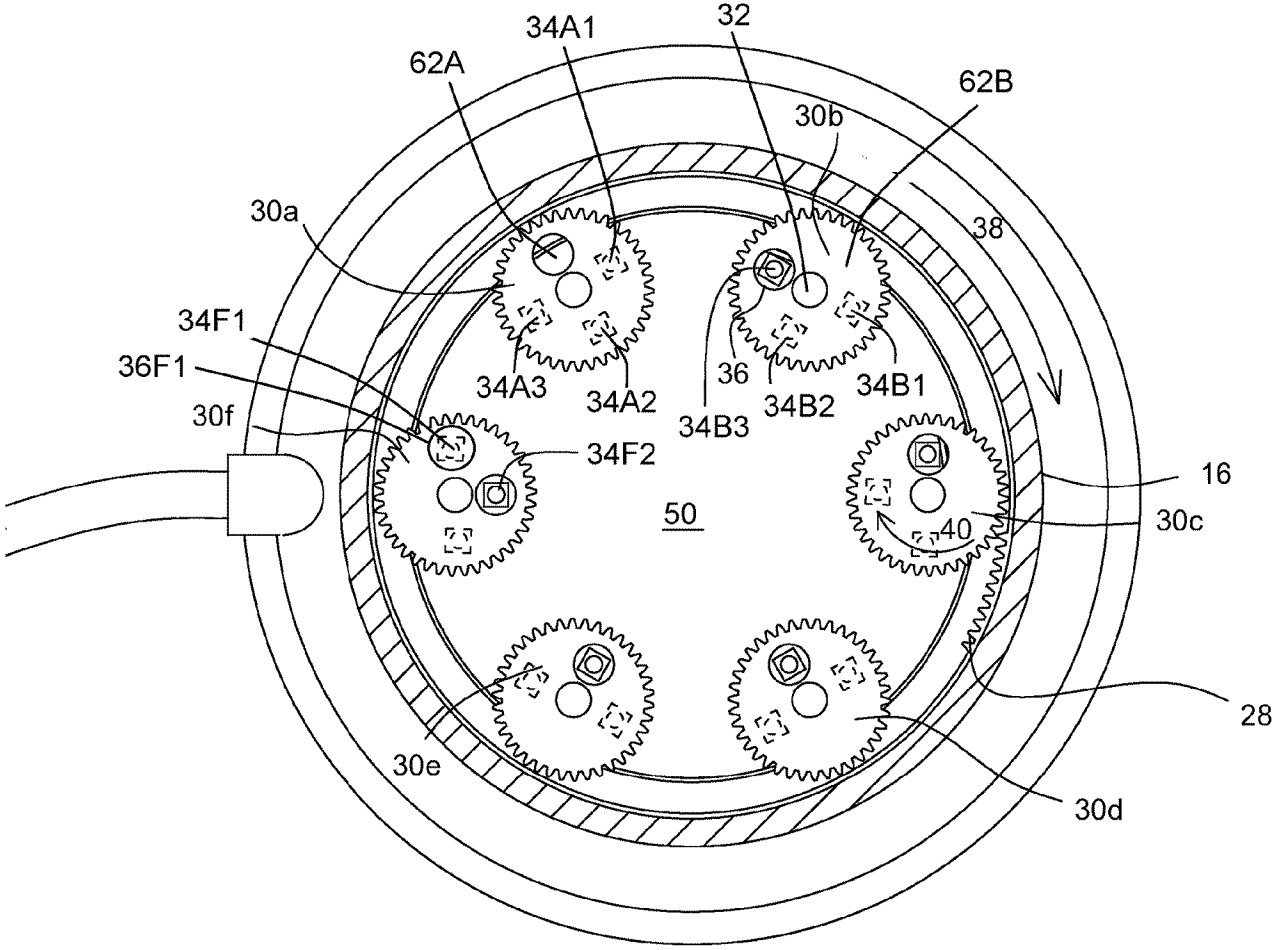
FIG. 4 is a top view, according to another embodiment.

FIG. 4 is a top view, according to another embodiment.

According to the embodiment of FIG. 4, a full scan of cogged segment 28 on any of covers 30A, 30B, etc. rotates the cover along a quarter of the circle, i.e., by 90 degrees. Thus, according to this embodiment, cogged segment 28 includes a quarter of the number of the teeth of each cover. Thus, in the example of FIG. 4, cogged segment 28 includes 10 teeth, whereas each of covers 30A, 30B, etc. includes 40 teeth.

In another words, the number of teeth, being 40 teeth, of each of round cogged rotatable covers 30A, 30B, etc., divided by the number of teeth of cogged segment 28, being 10 teeth, is 4, being an integer, thus the reciprocal of the integer 4, being a quarter, determines the fraction of the rotation of round cogged rotatable cover 30A, meaning it rotates along a quarter of the circle. Similarly the integer may be selected to be 3, 5, 6, 7, 8, 9, etc.

According to the embodiment of FIG. 4, circular plate 50 includes a plurality of light sources disposed under each cover. According to the specific embodiment shown in FIG. 4, circular plate 50 includes 3 light sources for each cover, each for being disposed under one cover, in a 90 degrees angular distance therebetween, thus one location of the four, as provided for the 90 degrees angular distance, does not include a light source.

For example, circular plate 50 includes 3 light sources for each cover, each for being disposed under one cover, in a 90 degrees angular distance therebetween, thus one location does not include a light source.

Namely, FIG. 4 depicts circular plate 50 including light sources 34A1, 34A2 and 34A3 disposed under cover 30A; light sources 34B1, 34B2 and 34B3 disposed under cover 30B; etc. Light sources 34A1, 34A2 and 34A3 are disposed in a 90 degrees angular distance therebetween, thus location 62A does not include a light source; light sources 34B1, 34B2 and 34B3 are disposed in a 90 degrees angular distance therebetween, thus location 62B does not include a light source; etc.

According to the above example of FIG. 4, a full scan of cogged segment 28 on any of covers 30A, 30B, etc., as rotating the cover along a quarter of the circle, changes the light source being exposed, or covers all of the light sources.

Each of light sources 34A1, 34B2, and 34B3 may have a different color and/or a different intensity, and/or different effects such as a different blinking rate.

According to one embodiment, each cover may include more than one aperture, e.g., cover 30F may include apertures 36F1 and 36F2, for allowing exposing two light sources, such as 34F1 and 34F2 together.

The parameters of the number of covers (30A) on plate 50, the number of light sources (34A1) and empty locations (62A) under each cover, and the number of apertures (36A1) for each cover, may apply various engineering considerations.

Figure 5:
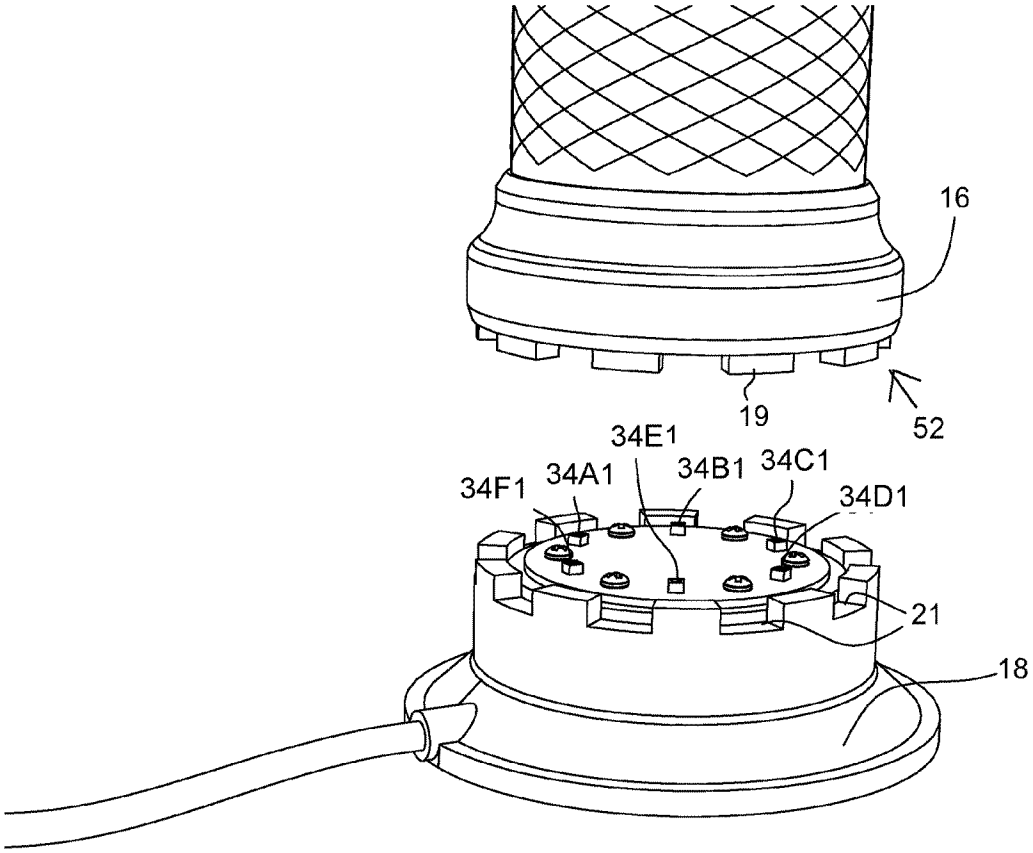
FIG. 5 is like FIG. 1, after assembling the rotatable handle to the covering assembly.

FIG. 5 is like FIG. 1, after assembling the rotatable handle to the covering assembly.

Upon closing a screw 27 of FIG. 1, rotatable handle 16 is rotatably connected to covering assembly 52. Then rotatable handle 16, being to covering assembly 52, may be placed on top of illuminating assembly 18, such that protrusions 19 of covering assembly 52 and depression 21 of illuminating assembly 18 are complementary one to the other, for avoiding rotation of covering assembly 52 in relation to illuminating assembly 18.

Figure 6:
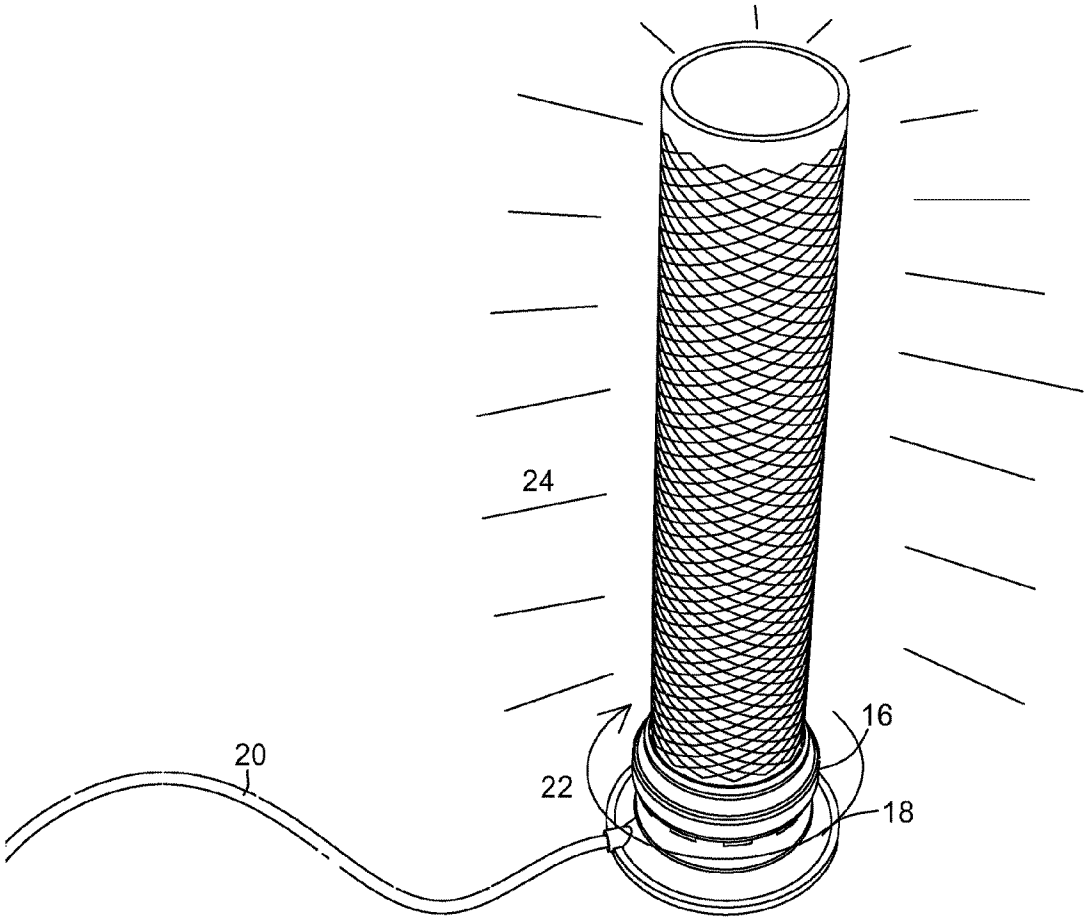
FIG. 6 is like FIG. 6, after placing the rotatable handle and the covering assembly on the illuminating assembly.

FIG. 6 is like FIG. 6, after placing the rotatable handle and the covering assembly on the illuminating assembly.

Rotation 22 of rotatable handle 16 in relation to illuminating assembly 18 adjusts the illumination 24 to the environment.

Thus, in one aspect, the invention is directed to a circular lamp (10), including:

- a plurality of light sources (34A1, 34B1) disposed around a circle (50);
- a round cogged rotatable cover (30A, 30B), disposed above each of the light sources (34A1, 34B1) for allowing covering thereof, wherein the round rotatable cover (30A, 30B) includes at least one aperture (36A1), for allowing exposing the light source (34A1);
- interlacing means (28), for allowing rotating at least one of the round cogged rotatable covers (30A, 30B), for circularly moving the at least one aperture (36A1) thereof,
- thereby allowing determining the number of the plurality of light sources (34A1, 34B1) to be covered.

The interlacing means (28) may constitute an internal circle (70) including a cogged segment (28), for allowing rotating one (30A) of the round cogged rotatable covers at a time, for making it either cover or expose the light source thereof (34A1).

The number of the teeth of each of the round cogged rotatable covers (30A, 30B) divided by the number of the teeth of the cogged segment (28) is an integer, thus the reciprocal of the integer determines the extent of the rotation of the of the round cogged rotatable covers, being currently rotated, thereby the reciprocal of the integer, as determining the rotation extent, ensures that full scans of the cogged segment (28) on any of the round cogged rotatable covers (30A, 30B) provide accurate appearances of the apertures (36A1), each above the light source (34A1) thereof.

The disposition of the plurality of light sources (34A1, 34B1) around the circle (50), constitutes disposition of each around a center (32), wherein the centers (32) are disposed around the circle (50). For example, in FIG. 4, light sources 34A1, 34A2, and 34A3 are disposed around one center 32; light sources 34B1, 34B2, and 34B3 are disposed around another center 32; and all centers 32 are disposed around a circle 74, enumerated in FIG. 2.

The plurality of light sources (34A1, 34B1) may include a plurality of light sources (34A1, 34B1) disposed around each of the centers (32).

Each of the light sources (34A1, 34B1) disposed around any of the centers (32), may have different characteristics, such as different colors, different intensities, different blinking rates.

In the figures and/or description herein, the following reference numerals (Reference Signs List) have been mentioned:

numeral 10 denotes the circular lamp according to one embodiment of the invention;
numeral 16 denotes a rotatable handle;
numeral 18 denotes the illuminating assembly;
numeral 19 denotes a protrusion;
numeral 20 denotes the electric cable;
numeral 21 denotes a depression;
numeral 22 denotes rotation of rotatable handle 16 in relation to illuminating assembly 18;
numeral 24 denotes illumination to the environment;
numeral 27 denotes a screw, for rotatably connecting rotatable handle 16 to covering assembly 52;
numeral 28 denotes the cogged segment, being the interlacing means for rotating the cogged covers;
numerals 30A, 30B, 30C, 30D, 30E and 30F denote round cogged rotatable covers;
numerals 34A1, 34A2, 34A3, 34B1, 34B2, 34B3, 34C1, 34D1, 34E1, and 34F1 denote light sources, such as LEDs, bulbs, etc.;
numerals 36A1, 36B1, 36C1, 36D1, 36F1 and 36F2 denote apertures;
numerals 38 and 40 denote available rotations among others;
numeral 50 denotes the round plate;
numeral 52 denotes the covering assembly;
numerals 62A and 62B denote locations around the center of the round cover, empty of light sources;
numeral 70 denotes an internal circle, for surrounding the plate and the cogged covers;
numeral 74 denotes a virtual circle between the centers of the round cogged covers 30A, 30B, etc.;

The foregoing description and illustrations of the embodiments of the invention have been presented for the purpose of illustration, and are not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

What is claimed is:

1. A circular lamp, comprising:
a plurality of light sources disposed around a circle;
a round cogged rotatable cover, disposed above each of said light sources for allowing covering thereof, wherein said round rotatable cover comprises at least one aperture, for allowing exposing the light source;
interlacing means, for allowing rotating at least one of said round cogged rotatable covers, for circularly moving said at least one aperture thereof,
wherein said interlacing means comprises an internal circle comprising a cogged segment, for allowing rotating one of said round cogged rotatable covers at a time, for covering or exposing the light source thereof,
wherein a number of teeth of each of said round cogged rotatable covers divided by a number of teeth of said cogged segment is an integer, wherein a reciprocal of said integer determines an extent of a rotation of said one of said round cogged rotatable covers,
thereby allowing determining a number of said plurality of light sources to be covered, and
thereby said reciprocal of said integer, as determining the rotation extent, ensures that full scans of said cogged segment on any of said round cogged rotatable covers provide accurate appearances of said apertures, each above the light source thereof.

2. A circular lamp comprising:
a plurality of light sources disposed around a circle;
a round cogged rotatable cover, disposed above each of said light sources for allowing covering thereof, wherein said round rotatable cover comprises at least one aperture, for allowing exposing the light source;
interlacing means, for allowing rotating at least one of said round cogged rotatable covers, for circularly moving said at least one aperture thereof,
wherein said disposition of said plurality of light sources around said circle, comprises disposition of each around a center, wherein said centers are disposed around said circle, and
wherein said plurality of light sources comprise a plurality of light sources disposed around each of said centers,
thereby allowing determining a number of said plurality of light sources to be covered.

3. A circular lamp according to claim 2, wherein each of said light sources disposed around any of said centers, comprises at least one different characteristic, wherein said characteristics are selected from a group consisting of: different colors, different intensities, different blinking rates.

* * * * *